US005141284A

United States Patent [19]

LaPointe

[11] Patent Number: 5,141,284

[45] Date of Patent: Aug. 25, 1992

[54] WALL PROXIMITY RECLINING CHAIR MECHANISM

[75] Inventor: Larry P. LaPointe, Temperance, Mich.

[73] Assignee: La-Z-Boy Chair Company, Monroe, Mich.

[21] Appl. No.: 647,017

[22] Filed: Feb. 1, 1991

[51] Int. Cl.[5] ..... A97C 1/02

[52] U.S. Cl. ..... 297/85; 297/329; 297/325

[58] Field of Search ..... 297/85, 329, 325, 258, 297/DIG. 7; 248/558, 670

[56] References Cited

U.S. PATENT DOCUMENTS 3,904,240 9/1975 Rogers, Jr. et al. ..... 297/85

4,307,865 12/1981 MacCready ..... 248/558 X 4,367,895 1/1983 Pacitti et al. ..... 297/85

4,715,654 12/1987 Laskowitz ..... 297/329

4,775,184 10/1988 Larkin ..... 297/434 X

*Primary Examiner*—Kenneth J. Dorner

*Assistant Examiner*—Milton Nelson, Jr.

*Attorney, Agent, or Firm*—Harness, Dickey & Pierce

[57] ABSTRACT

A "three-way" recliner mechanism for use in reclinable articles of furniture is disclosed. The recliner mechanism is operative for "tilting" the entire seating unit, "reclining" the seat back relative to the seat frame and for selectively extending and retracting a leg rest assembly. The recliner mechanism of the present invention incorporates separate bearing link assemblies for directly supporting the chair frame for translation movement relative to the base.

21 Claims, 8 Drawing Sheets

WALL PROXIMITY RECLINING CHAIR MECHANISM

BACKGROUND FOR THE INVENTIÓN

The present invention relates to furniture and, more particularly, to an improved reclining mechanism for articles of furniture such as chairs, sofas and loveseats.

In general, most conventional reclining chairs employ a relatively complex recliner mechanism which is operatively interconnected between a movable chair frame and a stationary base assembly. Tpyically, the recliner mechanism has an intermediate carriage assembly provided for supporting the chair frame for translational (i.e. fore and aft) movement relative to the base assembly. In addition, the translational movement of the carriage assembly causes corresponding reclining movement of a seat assembly between an "upright" position and a fully "reclined" position. One example of such a reclining chair is shown and described in U.S. Pat. No. 4,367,895 and which is assigned to the common assignee of tthe present invention.

Reclining mechanisms typically generate a relatively large amount of frictional drag which must be overcome for smooth movement between the "upright" and "reclined" positions. In particular, lighter weight seat occupants must normally exert a deliberate leveraged thrust or force, in addition to pulling the actuator level, for completely extending a leg rest assembly and/or moving the seat assembly to its "reclined" position. Morever, it is often difficult for the seat occupant to return the seat assembly to the "upright" position from the fully "reclined" position due to the relatively large included angle between the seat member and the reclined seat back. As such, the seat occupant must exert a relatively large and deliberate leveraged force to return the reclined seat assembly to its full upright position.

Another drawback associated with many conventional recliners is that the leg rest assembly cannot be retracted to its "stowed" position from an extended or elevated position until after teh seat occupant has completely returned the seat assembly to its fully "upright" position. Likewise, some reclining chairs do not permit independent actuation of the leg rest assembly during the entire range of reclining motion.

While most conventional reclining chairs operate satisfactorily, furniture maufacturers are continually striving to develop improved reclining mechanisms for reducing system complexity, increasing occupant comfort, and reducing the cost of fabrication and assembly.

SUMMARY OF THE INVENTION

In accordance with principles of the present invention, an improved reclining type article of furniture is disclosed which is designed to overcome the disadvantages typically associated with conventional reclining mechanisms. Therefore, a primary object of the present invention is to provide a reclining mechanism which eliminates the intermediate carriage assembly so as to significantly reduce the complexity, weight and cost of the reclining chair while providing improved comfort to the seat occupant.

It is an additional object of the present invention to provide a compact three-way recliner which permits use of loose cushions therwith. The three-way recliner is adapted to permit independent "reclining" movement of the seat back relative to the seat member, "tilting" movement of the chair frame relative to the base assembly, and actuation (i.e., extending and retracting) of the leg rest assembly. Tilt linkage means are provided roe angularly pivoting (i.e. tilting) the entire chair frame about a horizontal axis relative to the base assembly upon actuation of the leg rest assembly for optimizing seating comfort. In addition, curved track means of the base assembly are adapted to tilt the entire chair frame upon reclining movement. As such, tilting movement due to reclining movement of the seat assembly and loeg rest movement are independent of each other while being cumulative in nature.

It is another object of the present invention to reduce the input force exerted by the seat occupant for smoother operation of the reclining mechanism. As a related object, the improved reclining mechanism has incorporated various linkage and drive components designed for substantially reducing frictional losses in an effort to promote easier and smoother actuation. As such, the present invention provides a reclining chair wherein the weight of the person seated therein is utilized as the primary means for moving the seat assembly between the "upright" position and the "reclined" position.

In a preferred embodiment of the present invention, left and right wheeled bearing link assemblies are provided for directly interconnecting opposite sides of the chair frame to left and right channel-like tracks of the base assembly for permitting translational movement of the chair frame relative to the base assembly. Such translational movement of the chair frame coacts with a swing link mechanism interconnecting the seat assembly to the chair frame and a push link mechanism for causing "reclining" movement of the seat assembly relative to the chair frame. The seat assembly includes a seat back frame and a seat frame movably mounted on the chair frame and interconnected by the swing link mechanism for causing reclining movement of the seat assembly in response to pressure applied by the seat occupant. Furthermore, the pressure applied by the seat occupant acts to drive the push link mechanism for smoothly moving the chair frame during the reclining movement. In addition, the bearing link assemblies are operatively coupled to the tilt linkage means for causing independent "tilting" movement upon selective actuation of the leg rest assembly. Moreover, the bearing link assemblies are provided with adjustment means for permitting selective adjustment of the side-to-side relationship between the chair frame and the channel-like tracks for producing smoother and quieter translational movement therebetween.

The leg rest assembly is operated by the seat occupant rotating an actuator lever through a limited angle which, in turn, rotates a drive rod assembly for actuating the extensible leg rest pantograph linkages. An over-toggle mechanism is provided to assist in extending and retracting the leg rest assembly and in retaining the leg rest assembly in its "stowed" position. Also, a detent mechanism is provided for yieldably holding the leg rest assembly in one of several different protracted positions. In addition, rotation of the drive rod assembly concurrently actuates the tilt linkage means for "tilting" the chair frame relative to the stationary base assembly while the included angle between the seat back and seat member is maintained substantially constant throughout the entire range of "tilting" movement.

In accordance with another feature of the present invention, forward movement of the chair frame relative to the base assembly for "reclining" the seat assembly also acts to compensate for rearward angular movement of the seat back so as to maintain a substantially constant clearance between the seat back and an adjacent wall surface. Furthermore, due to the reduced frictional drag of the improved recliner mechanism, it is not necessary for the seat occupant to apply additional leverage with his arms or feet to initiate the desired reclining movement. In additional, "tilting" of the chair frame in conjunction with movement of the leg rest assembly and reclining movement of the seat assembly contributes significantly to the ease and smoothness of operation while also providing an added increment of comfort and consumer satisfaction.

Additional objects, advantages, and features of the present invention will become apparent from the following description and appended claims, taken in conjunction with the accompanying drawings.

DETAILED DESCRIPTION OF THE INVENTION

In accordance with the teachings of the present invention, an improved reclining mechanism for use in single person (i.e., chairs) and multi-person (i.e., sofas and loveseats) articles of furniture is disclosed. The reclining mechanism of the present invention is a "three-way" mechanism which can be actuated to independently "recline" a seat back relative to a seat member or move a leg rest assembly between retracted and extended positions. When a person sits in a chair equipped with the improved reclining mechanism, the leg rest assembly is extended by selectively rotating an actuator lever. In addition, substantially concurrent "tilting" movement of the entire chair frame is provided upon such rotation of the actuator lever. Moreover, a full range of independent "reclining" movement of the seat back relative to the seat member is possible regardless of the operative position of the leg rest assembly between its fully "retracted" and "extended" positions. This reclining movement also produces substantially concurrent "tilting" movement of the chair frame. [Therefore, tilting due to reclining movement of the seat back and tilting due to movement of the leg rest assembly are automatic, independent and cumulative in nature.] Finally, the reclining mechanism of the present invention is relatively compact in size to permit use of loose upholstered cushions which is essential for marketing all styles of chair, sofa or loveseat furniture.

Figure 1A:
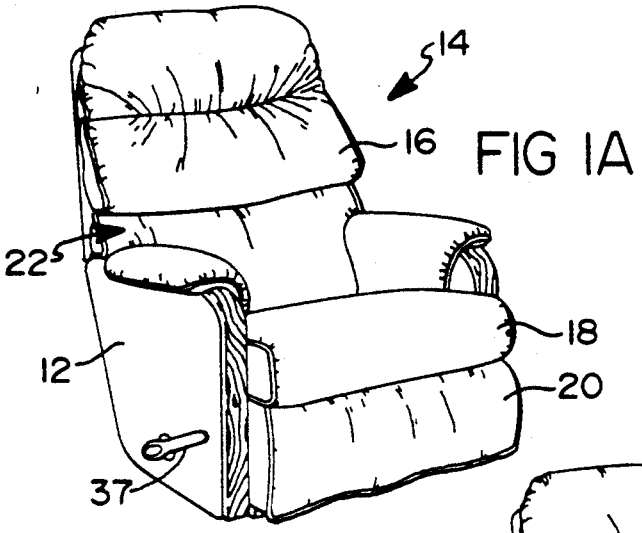
FIGS. 1A through 1D are perspective views of an exemplary upholstered reclining chair having an extensible leg rest assembly shown in various operative positions.
Figure 1B:
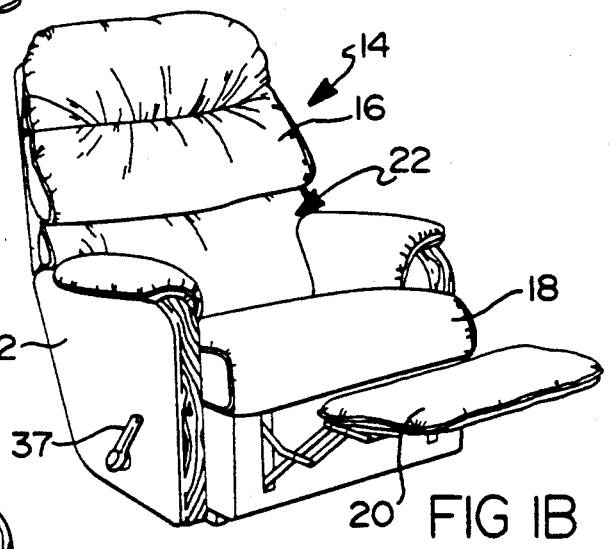
Figure 1C:
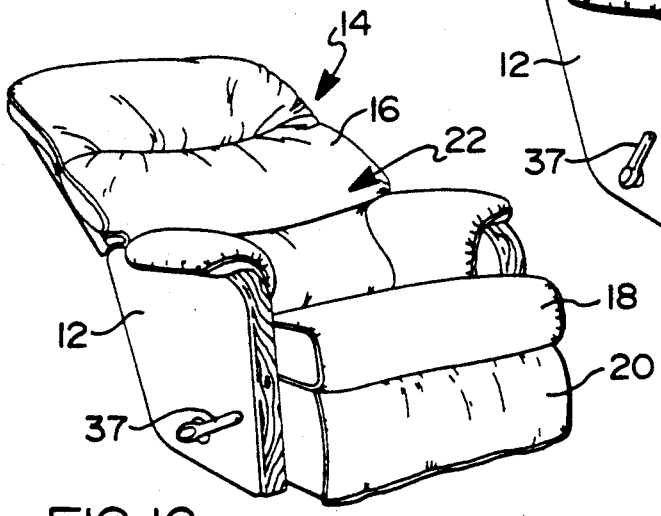
Figure 1D:
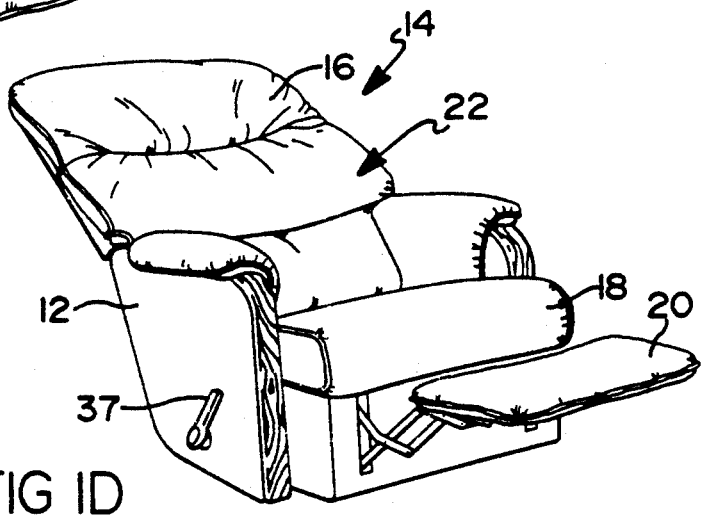

With particular reference now to the drawings, the operative relationship of an improved reclining mechanism 10 of the type adapted to support a prefabricated chair frame 12 will now be decribed. More particularly, FIG. 1A depicts an exemplary reclining chair 14 having its seat back 16 and seat member 18 shown in a fully "upright" position for permitting an occupant to enjoy conventional seating. FIG. 1B illustrates reclining chair 14 in the upright position with its associated leg rest assembly 20 being protracted to an elevated position. FIG. 1C illustrates chair 14 having seat back 16 moved to a "reclined" position relative to seat member 18 while leg rest assembly 20 is stowed in its retracted position. As will be described, seat back 16 and seat member 18 define a seat assembly 22 which is supported for reclining movement on chair frame 12. Reclining movement of seat assembly 22 is accomplished by the seat occupant deliberately applying pressure to seat back 16 such that a swing linkage mechanism causes seat member 18 to move forwardly and upwardly to maintain seating comfort while the included angle increases therebetween. All this is reversed, and chair 14 returned to its position upon deliberate application of rearward pressure to seat assembly 22 or, more simply, if the seat occupant leans forward to remove pressure from seat back 16. Finally, FIG. 1D depicts chair 14 in a reclined position with its respective leg rest assembly 20 extended. As will be described hereinafter in greater detail, movement of leg rest assembly 20 and/or reclining movement of seat assembly 22 cause corresponding tilting movement of chair frame 12 relative to the floor.

Figure 2:
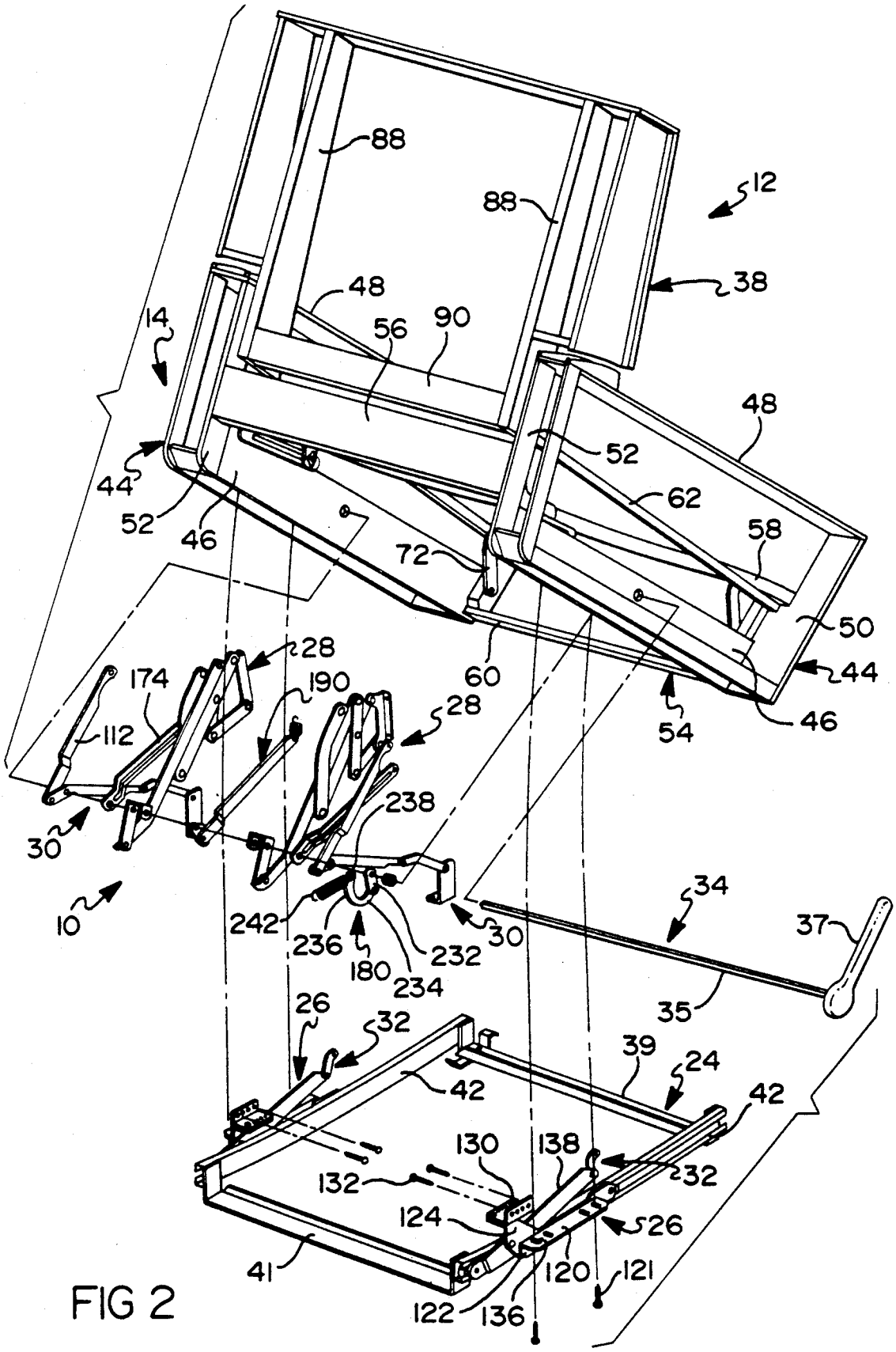
FIG. 2 is an exploded perspective view of the recliner chair of FIG. 1 with upholstery, springs, and other various parts removed, and which is partially disassembled for clarity, showing means for simply interconnecting the reclining mechanism to the chair frame.

With reference now to FIG. 2, an exploded perpective view of chair 14 is shown, with upholstery, padding, springs, etc. removed. In general, reclining mechanism 10 is shown to include a unitized base assembly 24, left and bearing link assemblies 26 operatively interconnecting chair frame 12 to base assembly 24 for translational (i.e. fore and aft) movement, left and right pantograph leg rest linkage mechanisms 28, left and right push link mechanisms 30, tilt linkage means 32, and a drive assembly 34 for selectively actuating leg rest linkages 28 and tilt linkage means 32. More specifically, drive assembly 34 is shown to include an elongated square drive rod 35 supported within chair frame 12 and having a handle portion 37 provided adjacent an exterior side arm portion of chair 14 that can be easily reached by a person seated therein for convenient actuation thereof. However, it will be appreciated that other suitable manually operable release means known in the art, such as a push-button cable relelase or an concealed interior mounted actuator lever, can be readily incorporated into improved reclining mechanism 10 of the present invention.

Figure 5:
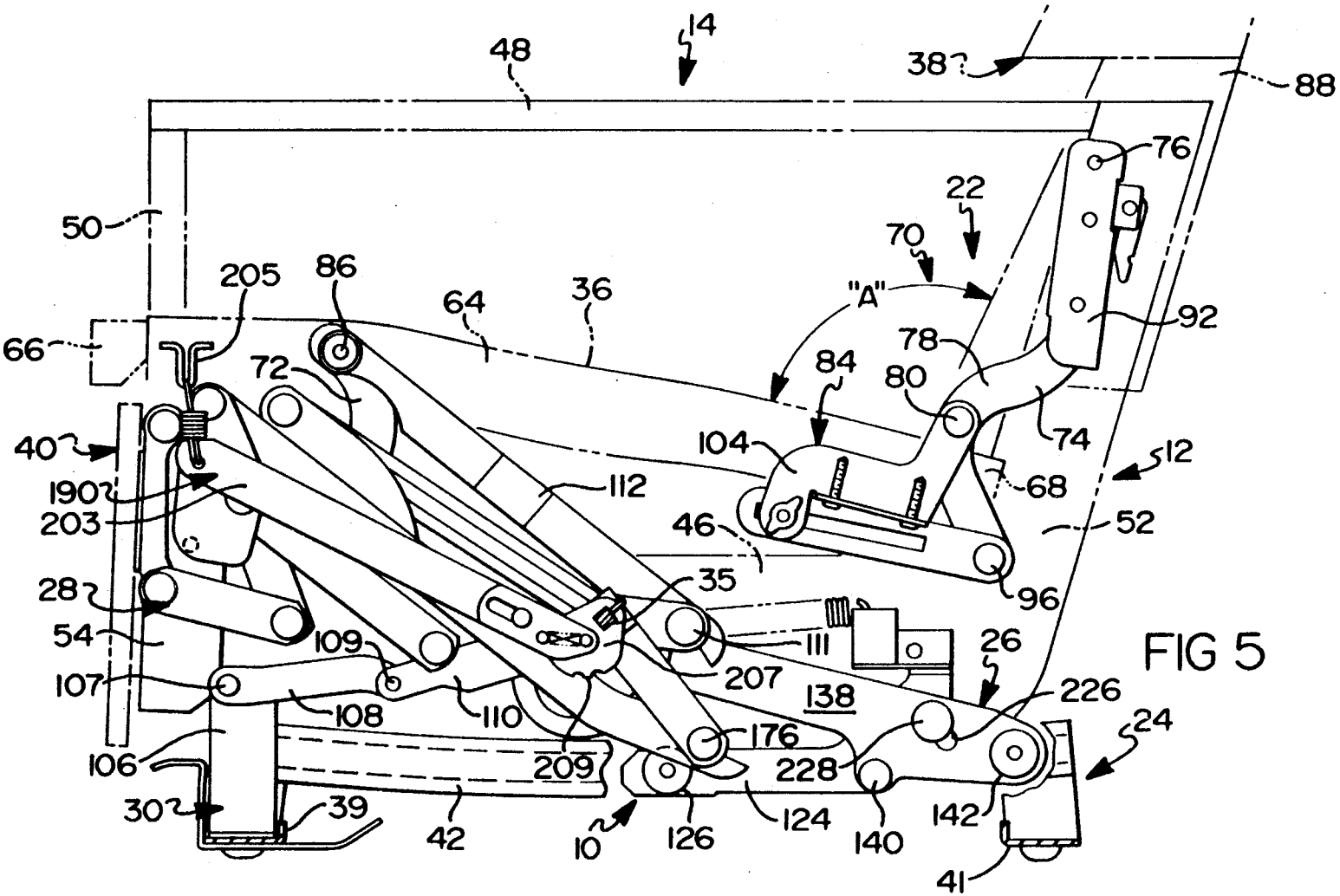
FIG. 5 is a partial schematic side view illustrating the reclining chair in an "upright" position.

With continued reference to FIG. 2, chair frame 12 is shown to be configured for retaining reclining mechanisms 10 substantially therein. As best seen in FIG. 5, various components of chair 14, such as chair frame 12, seat frame 36, seat back frame 38 and leg rest frame 40 are each constructed in a manner which enables them to support springs, padding, upholstery, etc., in order to complete a decorative and stylish chair 14 for use in the home. Preferably, these components are made of numerous wood rails that are fixedly secured together by suitable fasteners, such as dowels, staples, nails and screws, and which may be reingorced at critical joints by metal reinforcement plates of brackets and/or wood corner blocks in a known manner.

Unitized base assembly 24 forms a rigid rectangular frame defined by front and rear cross bars 39 and 41, respectively, secured to opposite ends of left and right metal channel-shaped tracks 42. Tracks 42 are outwardly facing and slightly curved relative to the floor and provide means for movably supporting left and right bearing link assemblies 26 so that they can move back and forth between front and rear cross bars 39 and 41. Base assembly 24 is adapted to be placed directly on the floor so as to eliminate the use of a heavy wooden base support typically used in most conventional reclining chairs. In addition, bearing link assemblies 26 are adapted to carry chair frame 12 so as to transfer substantially all loading from chair frame 12 and seat assembly 22 into base assembly 24.

As best seen in FIG. 2, chair frame 12 includes opposite side (i.e. left and right) frame members 44 in the form of rigid, roughly rectangular frames defined by relatively horizontal bottom members 46 and by relatively horizontal top members 48 which also function as chair arms. Each side frame 44 also includes a front post 50 which preferably hyas at least a lower portion substantially perpendicular to the floor. In addition, each side frame 44 has an inclined rear post member 52 such that front and rear posts 50 and 52, respectively, are rigidly secured to top and bottom horizontal members 44 and 46 respectively. The left and right hand side frames 44 are rigidly interconnected to form chair frame 12 by a front cross brace structure 54 and the rear cross brace member 56. The structure of front cross brace 54 comprises horizontal upper and lower cross pieces 58 and 60, respectively. A central wood post 62 is also shown for rigidly uniting front and rear posts 50 and 52. However, it is to be understood that chair frame 12 is merely exemplary in nature and that any suitble chair frame structure can be used with reclining mechanism 10.

Seat frame 36 is supported on chair frame 12 and is located between side frames 44 at a suitable distance between chair arms 48. Seat frame 36 is a rigid rectangular structure having left and right hand side bars 64 which are rigidly secured to opposite ends of front and rear cross pieces 66 and 68, respectively. Seat frame 36 is supported for movement on chair frame 12 by means of a swing linkage mechanism 70 for causing seat frame 36 to move substantially horizontally and slightly up or down, depending on whether seat frame 36 moves to the front (during recline) or to the rear (on return to upright). Swing linkage mechanism 70 includes left and right hand front swing links 72. More particularly, front swing links 72 are J-shaped members having their top ends pivotably connected to seat side bars 64 such that loading on seat frame 36 passes into front swing links 72. The lower end of J-shaped front swing links 72 are pivotably connected to a portion of front cross brace structure 54. Linkage mechanism 70 also includes left and right hand rear swing links 74 which extend vertically well above the level of seat frame 36 along side rear posts 52 of chair frame side frames 44 to which they are pivotably connected just below chair arms 48 about pivot point 76. A forwardly offset intermediate section 78 of rear swing links 74 is pivoted about pivot point 80 to an upstanding post section 82 of an angle seat bracket 84 having a horizontal flange securely fixed (such as by wood screws 85) to the underside surface of seat side bars 64 in relatively close proximity to the back end of seat frame 36. As such, loading on the rear of seat frame 36 passes from seat brackets 84 and pivots 80 into rear swing links 74 as tension in links 74 which is transferred by way of pivot 76 into chair frame 12. Thus, the rear of seat frame 36 moves much like a controlled pendulum on and below upper pivots 76 while the front of seat frame 36 swings to and fro above and on front piovt 86.

The primary means of moving rear swing links 74 is the application of pressure against seat back frame 38 above the level of pivot point 76, as when the seat occupant leans backward in chair 14. This action causes seat back frame 38 to pivot backwardly for causing rear swing links 74 to swing forwardly for initiating rolling forward movement of bearing link assemblies 26, and in turn, chair frame 12 in a manner to be described in greater detail hereinafter.

As is known, seat back frame 38 is also in the form of a rigid relatively rectangular assembly that includes right and left hand side members 88 and appropriate cross pieces, such as lower cross piece 90. Seat back frame 38 is removably mounted on the upper part of rear swing link 74 by means of slide brackets 92 secured at suitable locations on side members 88. A preferred form of slide brackets 92 for this type of mounting is shown and described in U.S. patent application Ser. No. 07/621,239 filed Nov. 30, 1990 and assigned to the common assignee of the present invention. More particularly, slide brackets 92 are channel-shaped to provide an interior track that slidably receives rear swing links 74 therein. When slide brackets 92 are mounted on rear swing links 74, seat back frame 38 is, in effect, an extension of rear swing links 74 above pivot points 76. As such, seat back frame 38 can be pivoted about pivots 76 for acting as a lever arm for causing relatively easy angularly movement of rear swing links 74. The force required for causing such movement, and thus fore and aft movement of chair frame 12, is preferably selectively adjustable via frictional resistance means shown in the form of a multiple layer left and right friction link members 94.

Friction links 94 have one end pivoted at 96 to a lower portion 98 of each rear swing links 74 and have an elongated slot 100 which receive a hand-adjustble spring-biased wing nut 102 and washer means (not shown) mounted on a downwardly extending forward arm 104 of seat brackets 84. As will be appreciated, the frictional resistance of links 94 to sliding movement of wing nut 102 in slot 100 and thus to pivotal movement of rear swing link 74 can be selectively adjusted by tightening wing nut 102 to suit the specific user of the chair. While not shown, spring means may be attached between forward extension 104 of seat brackets 84 and rear cross member 56 of chair frame 12 for normally biasing seat assembly 22 so as to assist in maintaining the "upright" included angle "A" between seat member 18 and seat back 16.

Left and right push link mechanisms 30 are provided for causing translational "fore and aft" movement of bearing linkage assemblies 26 and, in turn, chair frame 12 relative to base assembly 24 in response to the pressure applied by the seat occupant to seat back 16. In general, push linkage mechanisms 30 are interconnected between front cross bar 39 of base assembly 24 and pivots 86 at the forward portion of seat frame 36. More particularly, base brackets 106 extend vertically from front cross member 39 of base assembly 24. A first end of lower push links 108 are pivotally connected at pivot 107 to an upper end of base brackets 106. The opposite end of lower push links 108 are pivotally connected at pivots 109 to a first end of drive rod swing links 110 which are journally supported on drive rod 35. The opposite end of drive rod swing links 110 are pivotally connected at pivot 111 to the lower end of offset upper pull links 112, the upper ends of which are pivotally connected at pivot points 86 to the respective side bars 64 of seat frame 36. Preferably, drive rod swing links 110 have a central aperture through which a spacer sleeve 114 (FIG. 3) is disposed and which is concentrically supported on square drive rod 35. Thus, square drive rod 35 fixes the longitudinal position of drive rod swing links 110 and upper pull links 112 but is independently operable with respect to angular movement thereof. As such, when pressure is applied by the seat occupant to move between the FIG. 5 "upright" position and the FIG. 6 "reclined" position, push link mechanisms 30 cause corresponding fore and aft translational movement of chair frame 12 via movement of bearing linkage assemblies 26 within tracks 42. In addition, the slightly "down-hill" curvature of tracks 42 cause chair frame 12 to tilt relative to the floor upon translational movement thereof.

For purposes of clarity, the term "tilting" refers to angular movement of chair frame 12 and, in turn, seat assembly 22 about a horizontal axis relative to stationary base assembly 24. Such "tilting" movement occurs substantially concurrently with protraction of leg rest linkages 28 via selective rotation of actuator lever 37 by the seat occupant and/or upon reclining movement of seat assembly 22. The term "reclining" refers generally to the angular movement of seat assembly 22 relative to chair frame 12 and, more particularly, to the relative angular movement of seat back 16 with respect to seat member 18 via swing linkage mechanism 70 for increasing the included angle therebetween from a minimum "A" (i.e. upright) to a maximum "B" (i.e. reclined). Moreover, the present invention is designed to permit the seat occupant to select and maintain virtually any desired reclined position within the range of reclining movement between the included angles "A" and "B".

With particular reference now to FIGS. 3 through 9, the primary components of reclining mechanism 10 which produce the above-noted movement characteristics will now be described in more detail. As noted, reclining mechanism 10 includes left and right wheel bearing link assemblies 26 provided for movably supporting chair frame 12 for longitudinal "fore and aft" movement relative to tracks 42 of stationary base assembly 24. Moreover, the fore and aft movement of chair frame 12 causes substantially simultaneous corresponding reclining movement of seat assembly 22 and tilting movement of chair frame 12. In addition, wheel bearing link assemblies 26 are operatively coupled to tilt linkage means 32 for causing independent tilting movement of chair frame 12 upon corresponding actuation of leg rest assembly 20 via rotation of drive rod 35. As will be appreciated, upon raising leg rest assembly 20 to an intermediate position, tilt linkage means 32 only produces a proportional amount of tilting movement.

In general, left and right bearing link assemblies 26 are mirror-imaged wheeled assemblies disposed respectively for rolling movement in left and right tracks 42 of base assembly 24. Preferably, tracks 42 are aligned in parallel relationship and are slightly downwardly curved from back to front to generate a gravity-assisted "down-hill" rolling movement of the wheeled unit therein. More specifically, bearing link assemblies 26 each include an angled bracket 120 adapted to be securely affixed directly to the bottom edge surface of horizontal bottom members 46 of chair frame 12 such as by wood screws 121. Angled brackets 120 include a downwardly extending flange 122 connected to a bearing link member 124 having a forward wheeled rolling unit 126 supported thereon and which is rollingly disposed within tracks 42. The upper rear end of bearing link 124 has a right-angled flange 127 having at least one elongated slot 128 provided for permitting a secondary mounting bracket 130 to be adjustably mounted thereto. Secondary mounting bracket 130 is provided for securely attaching bearing link 124 to an inner veritcal surface of horizontal bottom members 46, such as by wood screws 132. Accordingly, elongated slot 128 on bearing link flange 127 and slots 136 in angled bracket 120 permit selective side-to-side adjustment of bearing link assemblies 26 to compensate for manufacturing tolerances in base assembly 24 and/or chair frame 12. A pivot lever 138 is pivotally connected to bearing link 124 and angle bracket 120 about pivot point 140. More particularly, pivot lever 138 includes a second rear wheeled unit 142 disposed for rolling in tracks 42 with the opposite end of pivot levers 138 secured to respective left and right "tilt" linkage means 32, the structure and operation of which will be described hereinafter.

Figure 6:
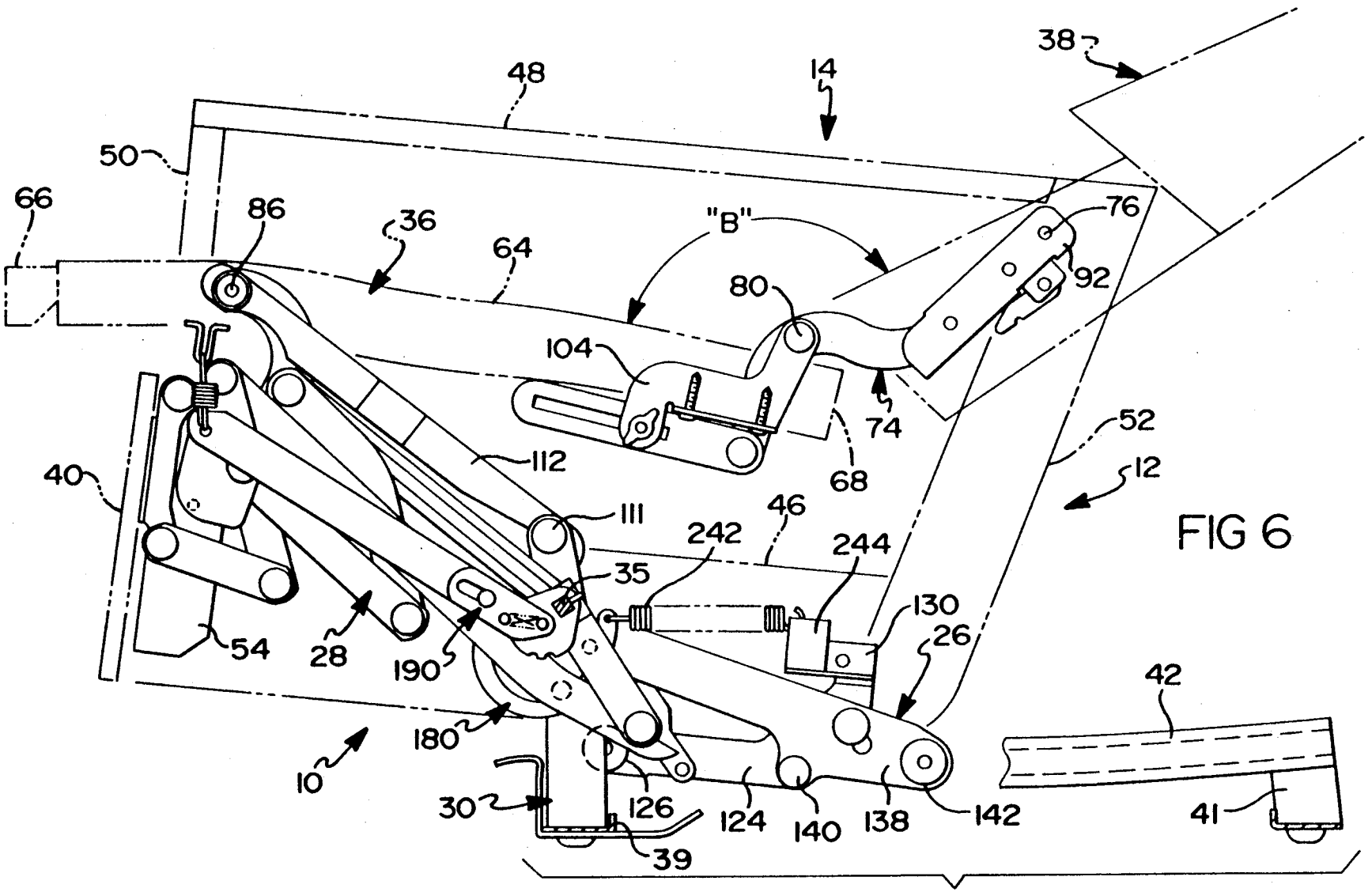
FIG. 6 is a side view, similar to FIG. 5, illustrating the reclining chair in a fully "reclined" and "tilted" position.
Figure 7:
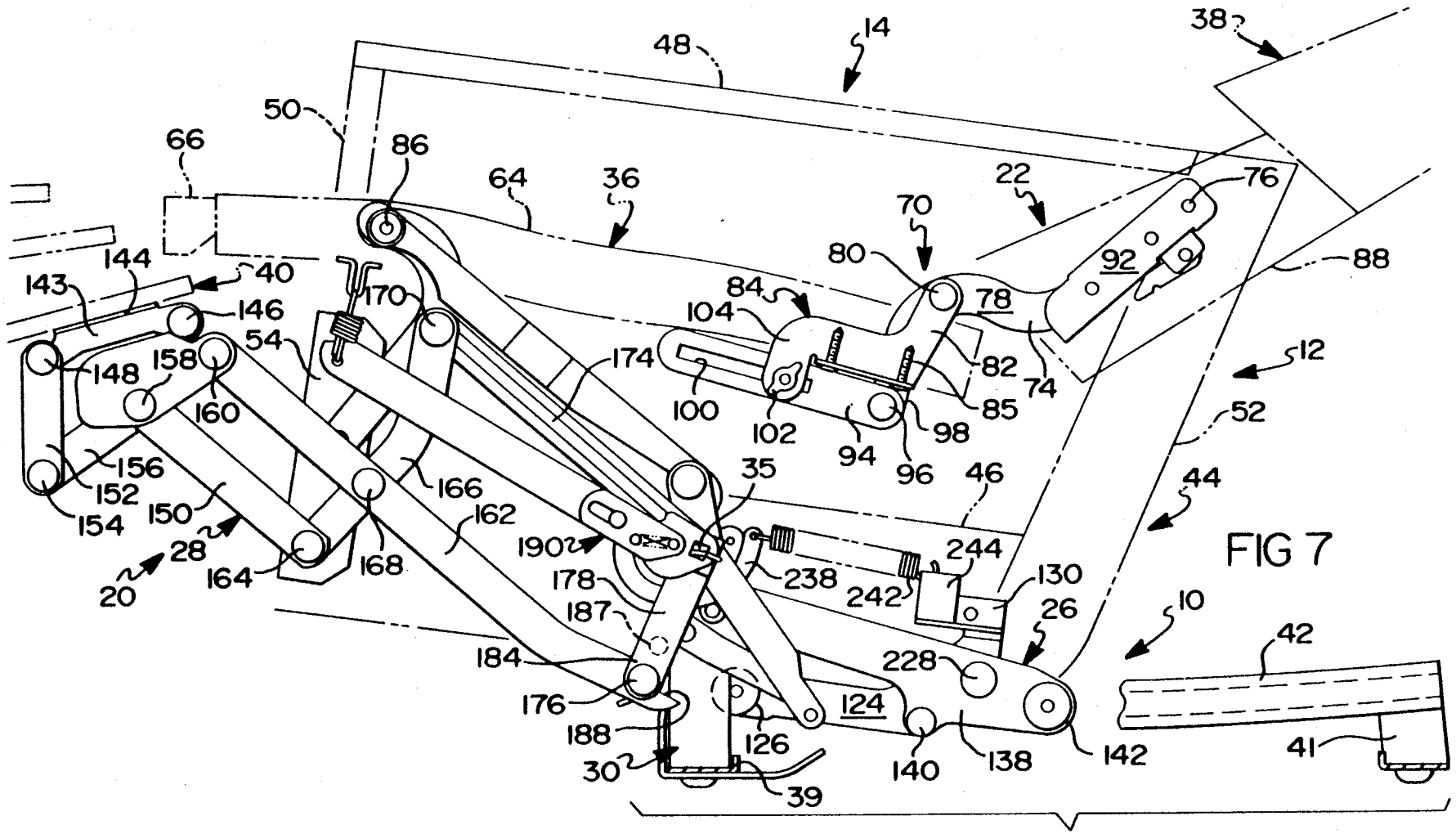
FIG. 7 is a side view, similar to FIG. 6, with the leg rest assembly in an extedned position wherein the chair frame is further "tilted" relative to the base assembly.
Figure 8:
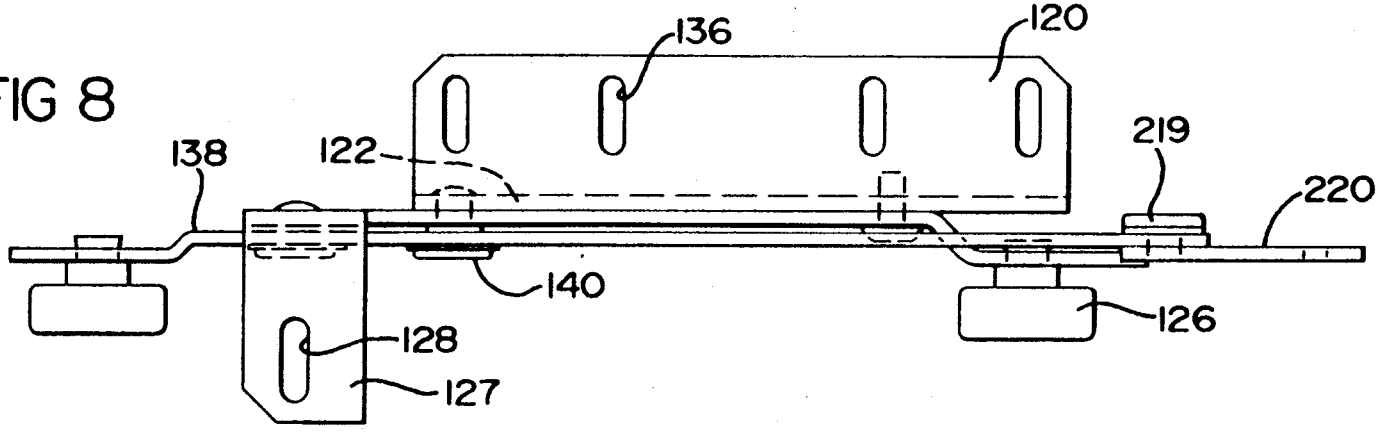
FIG. 8 is an enlarged plan view of the left-hand bearing link assembly shown in FIG. 3.
Figure 9:
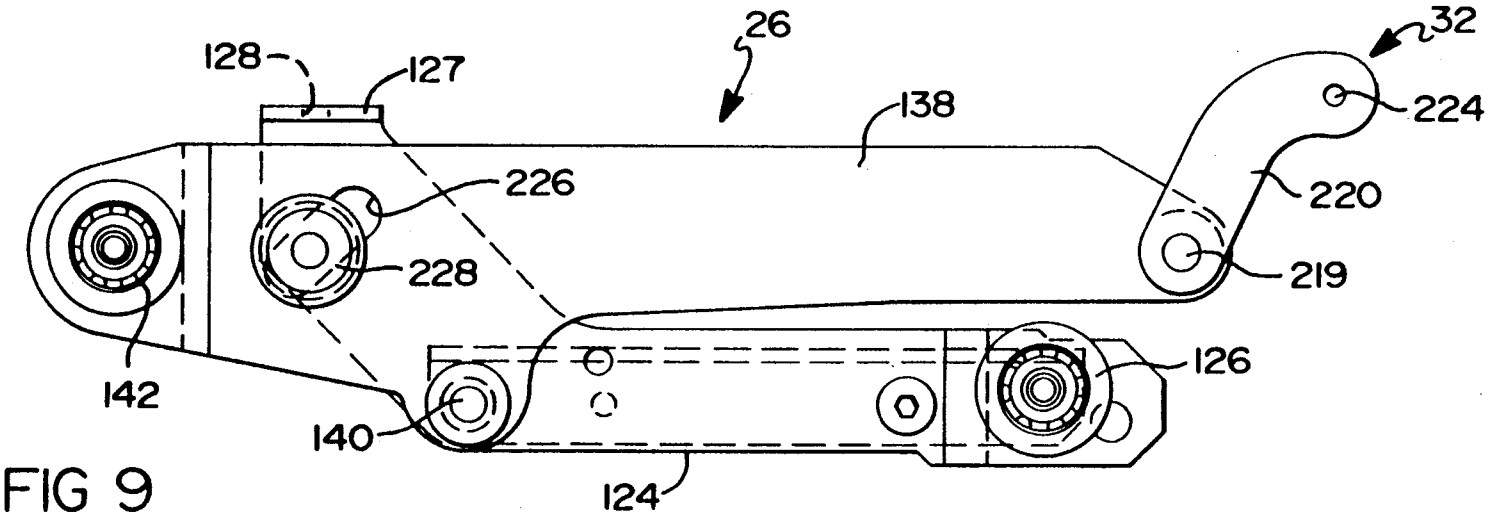
FIG. 9 is a side view of FIG. 8.

With particular reference now to FIGS. 5 through 7, leg rest assembly 20 is shown to include frame board 40 having an outer surface that is padded and upholstered so that finished chair 14 will be seen as in FIG. 1. Frame board 40 is supported and moved by identical left and right hand pantograph linkages 28. Pantograph linkages 28 are substantially identical in function and structure to that shown in FIG. 9 of U.S. Pat. No. 4,367,895. However, for a better understanding of their operation, a brief description is included herein. More particularly, frame board 40 has an angled bracket 143 secured to its bottom face 144 for each pantograph linkage 28 whereby board 40 is pivotably connected at a rear pivot 146 and a front pivot 148 to one end of board links 150 and 152, respectively, of pantographs 28. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 176. The other end of curved link 166 is pivotably connected at pivot 170 to a front support bracket 172 (FIGS. 3 and 4) mounted to chair frame front cross member 58. Ribbed offset lateral support members 174 extend from square drive rod 35 to pivot 170 to provide lateral support and maintain the desired spacing between left and right pantograph mechanisms 28.

Another point of support is pivot 176 at the curved bottom end of long support link 162 which connects link 162 to a first end of a drive link 178, the other end of which has a square aligned hole through which square drive rod 35 extends such that drive link 178 is driven by angular movement of drive rod 35. Thus, rotation of drive rod 35 turns drive link 178 which acts through pivot 176 to move long support link 162. Such movement of support link 162 causes curved link 166 to swing about fixed pivot 170 by virtue of pivot connection 168 that curved link 166 has with long support link 162. The action of link 166 swinging about fixed pivot 170 acts to move rear board link 150 outwardly and upwardly. In addition, pivot 169 at the top end of long support link 162 causes connector link 156 to swing about pivot 158 such that front board link 152 is also moved outwardly and upwardly. This extensible action takes place simultaneously with both the left hand and right hand pantograph linkage mechanism 28 when there is sufficient angualr rotation of drive rod 35 via handle 37. As such, the effect is to move frame board 40 between its stowed vertical position (FIG. 5) and one of its elevated protracted position (FIG. 7).

Figure 3:
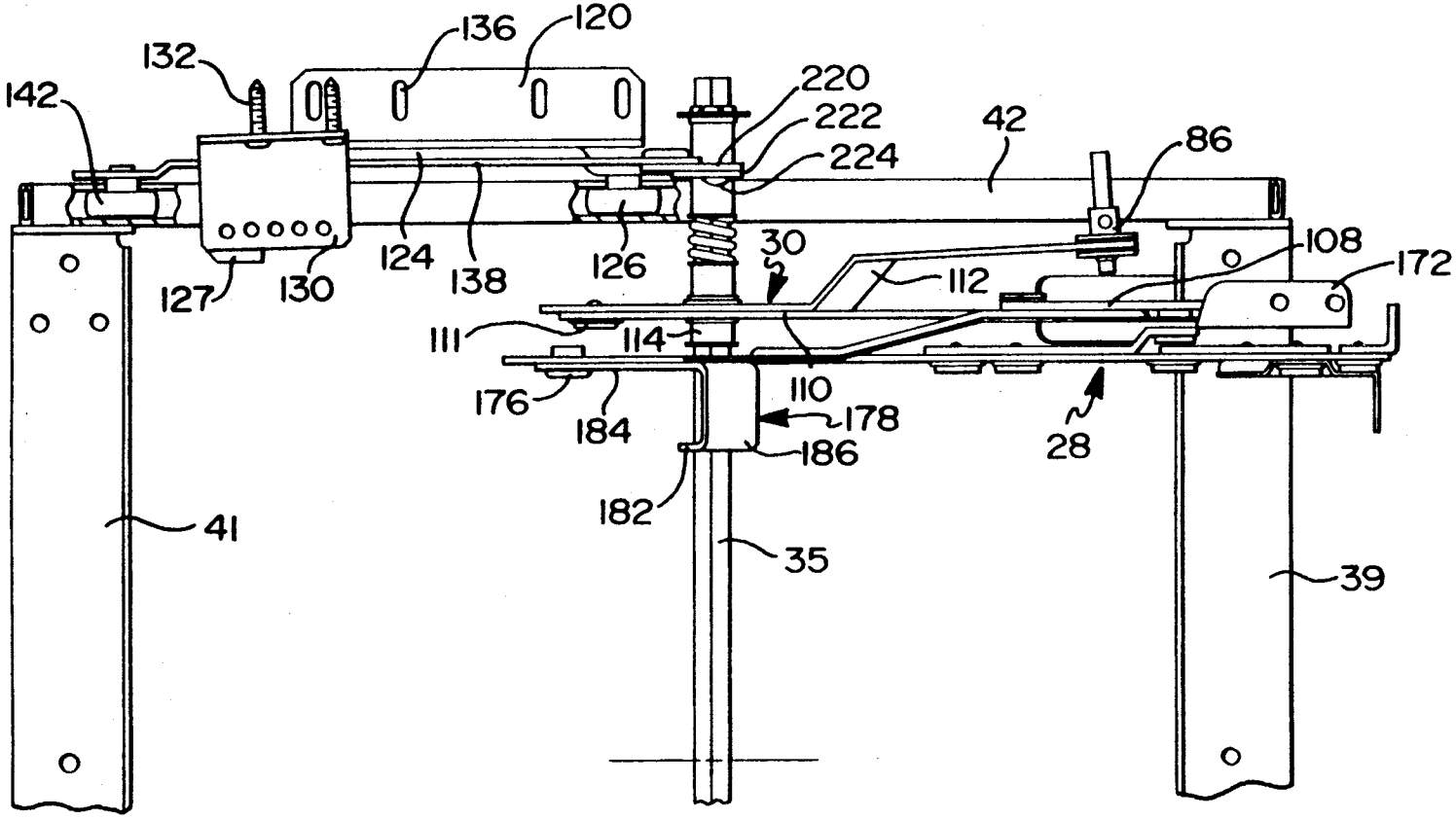
FIG. 3 is a plan view of a left-half portion of the recliner mechanism of FIG. 2.
Figure 4:
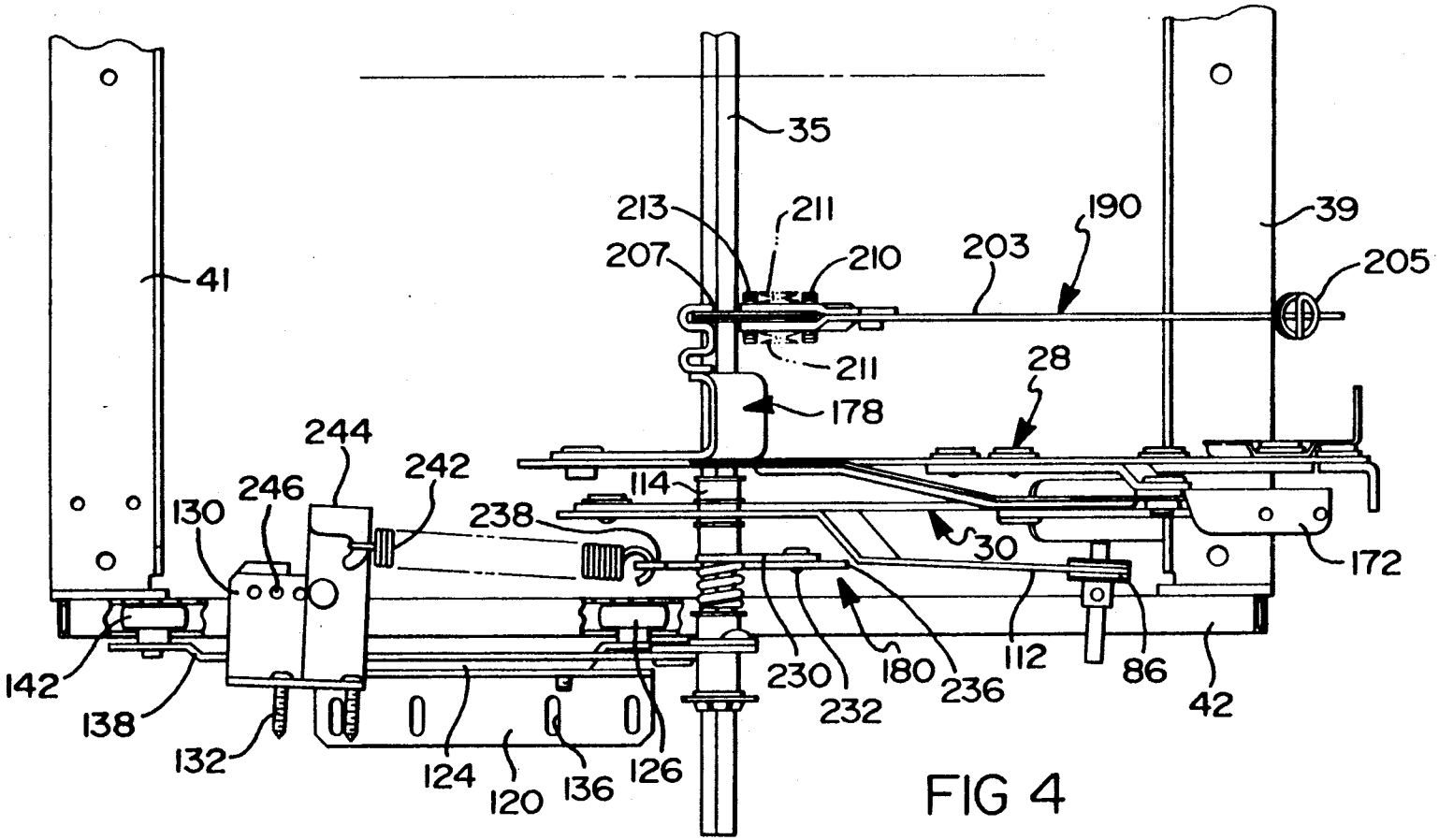
FIG. 4 is a plan view of a right-half portion of the recliner mechanism of FIG. 2.

As best seen in FIGS. 3 and 4, drive link 178 is generally U-shaped having parallel short and long legs 182 and 184, respectively, joined by a base 186. Both legs have square aligned holes in them through which the square drive rod 35 extends. In the fully extended horizontal position of leg rest assembly 20, a cold deformed stop tab 187 on long end 184 contacts a stop shoulder 188 formed on the lower end of long support link 162 when long leg 184 and link 162 are almost in relatively colinear alignment. Due to engagement of stop tab 187 and stop shoulder 188, pantograph linkages 28 cannot go over-center such that leg rest frame 40 is held in the protracted position. A ratchet type detent mechanism 190 interconnects drive rod 35 and front structure 56 of chair frame 12 for providing various intermediate locakble protracted positions for leg rest 20 (shown in phantom in FIG. 7).

The structure of ratchet mechanism 190 includes an inclined link 203 which is suspended at its front end from upper cross piece 58 of chair frame 12 by a tension spring hanger assembly 205. The other end of link 203 is bifurcated to receive a sector-shaped plate member 207 that is mounted by way of a square hole on drive rod 35 so as to rotate therewith. Ratchet plate 207 has specially shaped recesses 209 in its outer periphery which act as ratchet means cooperating with a floating detent pin 210 carrier by the bifurcations and urged into recesses 209 by tension springs 211 anchored on a pivot pin 213 between plate 207 and link 203. When drive rod 35 is rotated to operate a leg rest assembly 20, plate 207 is also rotated to expose different recesses 209 to pin 210 depending upon the degree of rod rotation and the elevation. When pin 210 is lockingly biased into one of recesses 209, leg rest assembly 20 is yieldably held in an elevated position against inadvertent angular movement by mechanism 190. Spring assembly 205 accommodates relative movement between link 203 and cross piece 58 due to movement of pin 213 upon rotational plate 207. Leg rest assembly 20 can only be returned to its stowed position from an intermediate position by fully protracting leg rest 20. Thereafter, reverse rotation of handle 37 cause pantograph linkages 28 to return to the FIG. 5 stowed condition.

As noted, reclining mechanism 10 is confined below seat frame 6 with tracks 42 being an integral portion of base assembly 24. In this manner, the wooden bottom support rails typically incorporated into conventional reclining systems have been eliminated. Therefore, an overall reduction in the height of recliner 10 permits use of loose cushions removably installed on top of seat frame 36. In addition, reclining mechanism 10 is designed to cause less upward angular movement of seat frame 36 than conventional recliners upon forward "reclining" motion thereof as well as during "tilting" movement for significantly reducing the effort required for the seat occupant to return seat assembly 22 to the upright position.

According to the present invention, selective angular movement of drive rod 35 about its axis causes actuation of leg rest assembly 20 and "tilting" movement of chair frame 12. In addition, the weight of the seat occupant and the center of gravity of seat assembly 22, defined by the orientation of front and rear wheeled units 126 and 142 disposed within tracks 42, combine to generate a forwardly directed force on bearing link assemblies 26 which tends to augment the limited occupant input (i.e. pressure to seat back 16) required for causing substantially smoother operation of recliner 10. In addition, an over-center spring-loaded toggle assembly 180 is designed to selectively assist in driving leg rest assembly 20 between its respective "stowed" and "extended" positions.

With particular reference now to FIGS. 2, 3, 4, 8 and 9, bearing bracket assemblies 26 are shown to be operatively coupled to tilt linkage means 32 for "tilting" chair frame 12 relative to the floor upon movement of leg rest assembly 20. In general, tilt linkage means 32 interconnect the forward end of pivot levers 138 of bearing link assemblies 26 to drive assembly 4. More particularly, the forwardmost end of pivot levers 138 extend below and are generally aligned with the axis of drive rod 35 and are pivotally connected at pivot 219 to a lower end of a J-shaped toggle link 220. The other end of J-shaped toggle link 220 is pivotably connected to a connector link 222 at pivot 224 and which, in turn, is secured on drive rod 35 for angular movement therewith. Tilt linkage mechanisms 32 inhibit tilting movement of chair frame 12 until actuator lever 37 and, in turn, drive rod 35 are rotated for causing pivotal movement of pivot levers 138 relative to bearing links 124. More particularly, pivot levers 138 are formed with a lost motion slot 226 through which a rivet 228, extending through bearing link 124, moves to define a limited range of angular movement between pivot levers 138 and bearing links 124. Therefore, upon rotation of drive rod 35, the corresponding rotation of connector link 222 cause toggle link 220 to drive the forward end of pivot levers 138 downwardly. At this point, the mechanical advantage of tilt linkages 32 act to forwardly drive J-shaped toggle 220 around and below drive rod 35 so as to permit pivot levers 138 to pivot about pivot points 140 such that bearing link assemblies 26 and, in turn, chair frame 12 are "tilted" relative to tracks 42. In addition, rivet 228 provides structural support to chair 14 for maintaining the alignment and rigidity of pivot lever 138 for causing wheeled unit 142 to run straight within track 42. As such, lateral (i.e. side-to-side) cross-members can be eliminated since the rigidity of chair frame 12 is used to maintain correct wheel alignment to track 42.

As best seen in FIGS. 4 and 7, at least one spring-assist toggle assemblies 180 is provided which, as pointed out in U.S. Pat. No. 4,367,895, works coactively with leg rest pantograph linkages 28. Toggle assembly 180 provides means for holding leg rest assembly 20 tightly in a fully retracted (i.e., stowed) position against front brace structure 54 of chair frame 12 while also providing means for supplying a spring force for driving leg rest assembly 20 toward one of its extended positions. Toggle assembly 180 includes a toggle lever 230 with a square hole which is mounted by means of the square hole on square drive rod 35 for selective rotation therewith. Toggle lever 230 is pivotally connected at pivot 232 to front leg 234 of a C-shaped toggle link 236 that curves around, below and to the rear of drive rod 35 where its rear leg 238 has an opening in which one end of a helical coil spring 242 is hooked. The opposite end of spring 242 is hooked to a spring bracket 244 which is secured to secondary mounting bracket 130. Tension adjustment means, such as a plurality of holes 246 in mounting bracket 130, are provided for adjusting the tension in spring 242. For example, the tension in spring 242 can be adjustable relieved for a lighter weight occupant or it can be increased for a heavier seat occupant. Such adjustment means provide an extra comfort and convenience feature to reclining mechanism 10.

Operation of toggle assemblies 180 will now be described in greater detail. The location of pivot 232 below drive rod 35 and the line of action of spring 242 are such that in the retracted position of leg rest assembly 20, the spring force holds or "retains" leg rest assembly 20. As leg rest 20 is initially exerted upon slight rotation of actuator lever 37 and, in turn, drive rod 35, pivot 232 moves up and over center of the drive rod axis. Once pivot 232 is over-center, tension loading on spring 242 assists in drivingly rotating drive rod 35 for elevating leg rest assembly 20 as rear leg 238 of link 236 is pulled toward secondary mounting bracket 130. In addition, spring 242 assists the occupant in pivoting handle 37 through the require actuation angle. Furthermore, toggle assembly 180 is adapted to utilize the spring biasing force of spring 242 to assist in returning leg rest assembly 20 to its stowed position upon reverse rotation of handle 37.

According to the operative principles of the present invention, leg rest assembly 20 and the associated tilting movement of chair frame 12 on base assembly 24 both occur upon selective angular movement of handle lever 37. Operation of the recline feature of reclining mechanism 10 and its associated tilting movement of chair frame 12 however, occur simply by weight shifting on the part of the seat occupant with no spring or lever assistance. When the chair occupant lets the weight of his or her back rest heavily against seat back frame 38, most of the load will be concentrated above pivots 76 so that rear swing links 74 plus seat back frame 38 become long lever arms that transform the pressure applied into forward motion of bearing link assemblies 26 in tracks 42 via actuation of push link mechanisms 30. To reverse this motion and return chair 14 to its upright position, the seat occupant simply leans forward to take his or her weight off seat back frame 38 and let that weight component be carried by seat frame 36. The weight balance provided by swing linkage 70 and tilt linkage 32 in conjunction with the load balancing due to the positioning of wheeled units 126 and 142 in tracks 42, enable the translational movements just described to be started, continued and terminated without the need for the set occupant to push against chair arms 48 or any other forms of additional leverage.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A reclining chair comprising:

a chair frame;

track means secured to a base assembly;

a seat assembly having a seat member, and a seat back;

swing link means pivotally supporting said seat back and seat member from said chair frame for causing said seat assembly to move between a non-reclined position and a fully reclined position in response to pressure applied by a seat occupant to said seat back;

a pair of pivotable bearing link assemblies connected to left and right side portions of said chair frame, each bearing link assembly having spaced wheel means which are respectively disposed for translational rolling movement within said track means;

a leg rest assembly supported from said chair frame for movement between a retracted position and an extended position;

manually operated actuation means for selectively moving said leg rest assembly between said retracted and extended positions;

tilt linkage means operatively connecting said manually operated actuation means to said pivotable bearing link assemblies for causing tilting movement of said chair frame relative to said base assembly in response to movement of said leg rest assembly; and push linkage means connected between said base assembly and said seat assembly and adapted to coact with said swing link means for causing translational movement of said chair frame in response to reclining movement of said seat assembly, whereby said seat assembly can be moved through a range of reclined positions independently of actuation of said leg rest assembly.

2. The reclining chair of claim 1 wherein said pivotable bearing link assemblies each comprise a pair of lever means pivoted together only one of which is connected to said chair frame, wherein said wheel means comprises a wheel on each said lever means, whereby said lever means are operable to tilt said chair frame relative to said wheels when said tilt linkage means is moved in response to movement of said manually operated actuation means.

3. A reclining chair comprising:

a chair frame;

track means secured to a base assembly;

a seat assembly having a seat member, a seat back;

swing link means pivotally supporting said seat back and seat member from said chair frame for causing said seat assembly to move between a non-reclined position and a fully reclined position in response to pressure applied by a seat occupant to said seat back;

left and right bearing link assemblies each having spaced wheel means which are respectively disposed for translational rolling movement within said track means, said track means being curved for causing angular tilting movement of said chair frame relative to said base assembly upon translational movement of said bearing link assemblies within said track means;

a leg rest assembly supported from said chair frame or movement between a retracted position and an extended position;

manually operated actuation means for selectively moving said leg rest assembly between said retracted and extended positions;

tilt linkage means operatively connecting said manually operated actuation means to said bearing link assemblies for tilting said chair frame relative to said base assembly in response to movement of said leg rest assembly; and push linkage means connected between said base assembly and said seat assembly and adapted to coact with said swing link means for causing translational movement of said chair frame in response to reclining movement of said seat assembly, whereby said seat assembly can be moved through a range of reclined positions independently of actuation of said leg rest assembly.

4. The reclining chair of claim 3 wherein said tilting movement of said chair frame due to reclining movement of said seat assembly is independent of and cumulative with said tilting movement of said chair frame due to movement of said leg rest assembly.

5. The reclining chair of claim 4 wherein said track means define left and right channel-like tracks located substantially within said chair frame, and which are curved forwardly from back to front, said bearing link assemblies having pivot means interconnected to said tilt linkage means for tilting said chair frame upon selective actuation of said manually operated actuation means.

6. The reclining chair of claim 5 wherein said bearing link assemblies are directly secured to said opposite side portions of said chair frame, said bearing link assemblies including adjustment means for selectively adjusting the side-to-side relationship of said wheel means within said tracks.

7. The reclining chair of claim 6 further comprising drive means having a transverse rotatable drive rod with said manually operated actuation means being operatively connected to said drive rod for selectively rotating said drive rod, and wherein said leg rest assembly and said tilt linkage means are operably connected to said drive rod such that upon said leg rest assembly moving from said retracted position toward said extended position said tilt linkage means drives said pivot means for tilting said chair frame.

8. The reclining chair of claim 7 wherein said tilt linkage means is a first toggle linkage mechanism interconnected between said drive rod and said pivot means of said bearing link assembly whereby rotation of said drive rod moves said first toggle linkage mechanism and movement of said first toggle linkage mechanism rotates said drive rod.

9. The reclining chair of claim 8 wherein said toggle linkage mechanism includes a connector link mounted for rotation on said drive rod and a toggle link pivotally connected about a first pivot to one end to said connector link, said toggle link being pivotally connected about a second pivot at its opposite end to a pivot lever of said bearing link assembly, said pivot lever having a first rear wheeled unit disposed in its associated track, said bearing link assembly also including a bearing link member pivotably connected to said pivot lever and having a second forward wheeled unit disposed in said track, and wherein said bearing link member is adapted to support bracket means for directly affixing said bearing link member to said side portion of said chair frame for supporting said chair frame and seat assembly thereon.

10. The reclining chair of claim 9 wherein said leg rest assembly includes pantograph linkage means operatively connected to said drive rod such that rotation of said drive rod moves said leg rest assembly and movement of said leg rest assembly rotates said drive rod, and wherein said reclining chair further includes a second toggle linkage mechanism operatively connected to said drive rod, said second toggle linkage mechanism adapted for retaining said leg rest assembly in said retracted position when said manually operated actuation means is rotated in a first direction, said second toggle linkage mechanism being adapted for forwardly driving said leg rest assembly toward said elevated position upon said manually operated actuation means being rotated in a second opposite direction.

11. The reclining chair of claim 10 wherein said second toggle linkage mechanism is an over-center device including a toggle lever secured to said drive rod for rotation therewith, said toggle lever pivoted to a first leg of a C-shaped toggle link which curves around and below said drive rod and which has a second rear leg, and spring means secured between a portion of said bearing link assembly rearward of said toggle link and said second leg thereof, whereby said spring means acts on said drive rod to bias said leg rest assembly toward its retracted position when said pivot connection between said toggle lever and said front leg of said toggle link is located below said drive rod and wherein said spring means forwardly drives said leg rest assembly toward its extended operative position when said pivot connection between said toggle lever and said front leg of said toggle link is rotated above said drive rod via rotation of said manually operated actuation means.

12. A reclining chair comprising:

a chair frame;

a base having curved track means;

a seat assembly having a seat and a seat back;

swing link means for supporting said seat assembly within said chair frame, said swing link means permitting reclining movement of said seat assembly between a rear-upright position and a forward-reclined position in response to pressure applied by a seat occupant to said seat back;

translational means supporting said chair frame on said base and operatively associated with said swing link means for causing fore and aft translational movement of said chair frame in response to said reclining movement of said seat assembly, said translational means including a pair of laterally spaced bearing link assemblies each having front and rear wheeled units that are operatively disposed within said curved track means, said curved track means being constructed and arranged for causing tilting movement of said chair frame relative to said base upon said seat assembly moving from said rear-upright position toward said forward-reclined position;

a leg rest assembly having pantograph linkage means supported from said chair frame and movable between a retracted position and an extended position;

manually operated actuation means for selectively moving said leg rest assembly between said retracted and extended position; and pivot link means operably coupling said bearing link assemblies to said manually operated actuation means for causing independent tilting movement of said chair frame relative to said base when said leg rest assembly is moved from said retracted position to said extended position, whereby operation of said leg rest assembly is selectively controlled by said manually operated actuation means independently of said translational means which is selectively controlled in response to pressure applied to said seat back by said seat occupant.

13. The reclining chair of claim 12 wherein said tilting movement of said chair frame due to reclining movement of said seat assembly is independent of and cumulative with said tilting movement of said chair frame due to movement of said leg rest assembly.

14. The reclining chair of claim 12 further including drive means for operatively connecting said manually operated actuation means to said pivot means and said leg rest assembly for causing said pivot link means to angularly tilt said chair frame in response to movement of said leg rest assembly such that said chair frame is tilted an amount corresponding to and proportional with the amount of movement of said leg rest assembly, and wherein said translational means further includes push link means operable for causing translational movement of said chair frame relative to said curved track means in response to reclining movement of said seat assembly such that said translational and tilting movement is proportional to the amount of reclining movement of said seat assembly.

15. The reclining chair of claim 12 wherein said manually operated actuation means includes a hand operated lever for operation by a person seated in the chair in order to move said leg rest.

16. The reclining chair of claim 12 wherein said curved track means define left and right channel-like tracks, said left and right bearing link assemblies directly connecting opposite side portions of said chair frame and having its wheeled units disposed in their respective track, said bearing link assemblies including adjustment means for selectively adjusting the side-to-side relationship of said wheeled units within said tracks.

17. A reclining chair comprising track means, a chair frame, a pair of laterally spaced bearing link assemblies supporting said chair frame and having spaced wheel means disposed in said track means for longitudinal translation between rear and forward positions, said track means being curved for causing tilting movement of said chair frame during said longitudinal translation thereof, tilt means for tilting said chair frame about a horizontal axis, a leg rest assembly, drive means supporting said leg rest assembly on said chair frame for movement between retracted and elevated positions, a seat back frame, a seat frame, swing link means supporting said seat back frame and said seat frame on said chair frame for reclining movement between upright and fully reclined positions, push link means operatively interconnecting said support means and said swing link means and responsive to pressure applied to said seat back frame whereby movement of said seat back frame causes translational and tilting movement of said chair frame in an amount corresponding to the amount of reclining movement of said seat back frame, actuation means for moving said leg rest assembly on said drive means, and means interconnecting said tilt means and said drive means for tilting said chair frame in response to movement of said leg rest assembly whereby movement of said leg rest assembly acts to automatically tilt said chair frame about said axis in an amount proportional to the amount of movement of said leg rest.

18. The reclining chair of claim 17 wherein said swing link means is provided for securing a rear portion of the said seat frame to intermediate points on rear swing links secured to said chair frame whereby said frame is supported on and moves with said rear swing links, said swing link means including front swing links secured to a front portion of said seat frame and to said chair frame for movably supporting said front of said seat frame on said chair frame, said chair frame being tiltably mounted on said pair of wheeled bearing link assemblies supported for translation movement with said track means, and wherein said tilt means includes a tilt linkage for tilting said chair frame on said bearing link assemblies independently of the reclined position of said seat back frame, said track means being slightly curved downwardly from back to front for tilting said chair frame upon translational movement of said bearing link assemblies in said track means.

19. The reclining chair of claim 18 wherein said bearing link assemblies include adjustable means for controlling the side-to-side relationship of wheeled portions of said bearing link assemblies within said track means.

20. The reclining chair of claim 18 further including leg rest hold means for releasably holding said leg rest assembly in a selected one of several elevated positions.

21. The reclining chair of claim 17 wherein said track means define left and right channel-like tracks located substantially within said chair frame, and wherein said bearing link assemblies each having spaced wheel means which are respectively disposed for translational rolling movement within said left and right tracks, said bearing link assemblies having pivot means interconnected to said tilt means for tilting said chair frame upon selective actuation of said manually operated actuation means.

* * * * *

UNITED STATES PATENT AND TRADEMARK OFFICE

CERTIFICATE OF CORRECTION

PATENT NO. : 5,141,284

DATED : August 25, 1992

INVENTOR(S) : Larry P. LaPointe

It is certified that error appears in the above-identified patent and that said Letters Patent is hereby corrected as shown below:

Column 1, line 12,
"Tpyically" should be --Typically--.

Column 1, line 22,
"tthe" should be --the--.

Column 1, Line 42,
"teh" should be --the--.

Column 1, Line 54,
After "with" insert --the--.

Column 1, line 66,
"therwith" should be --therewith--.

Column 2, line 3,
"roe" should be --for--.

Column 2, line 11,
"loeg" should be --leg--.

UNITED STATES PATENT AND TRADEMARK OFFICE

CERTIFICATE OF CORRECTION

PATENT NO. : 5,141,284

DATED : August 25, 1992

INVENTOR(S) : Larry P. LaPointe

It is certified that error appears in the above-identified patent and that said Letters Patent is hereby corrected as shown below:

Column 2, line 57,
"over-toggle" should be --over-center toggle--.

Column 3, line 11,
"additional" should be --addition--.

Column 3, line 42,
"extedned" should be --extended--.

Column 4, line 2,
Delete "[".

Column 4, line 5,
Delete "]".

Column 4, line 44,
After "and" insert --right--.

Column 4, line 58,
"relelase" should be --release--.

UNITED STATES PATENT AND TRADEMARK OFFICE

CERTIFICATE OF CORRECTION

PATENT NO. : 5,141,284

DATED : August 25, 1992

INVENTOR(S) : Larry P. LaPointe

It is certified that error appears in the above-identified patent and that said Letters Patent is hereby corrected as shown below:

Column 5, line 5,
"reingorced" should be --reinforced--.

Column 5, line 29,
"hyas" should be --has--.

Column 5, line 42,
"suitble" should be --suitable--.

Column 6, line 12,
"piovt" should be --pivot--.

Column 6, line 48,
"hand-adjustble" should be --hand-adjustable--.

Column 8, line 18,
"veritcal" should be --vertical--.

Column 8, line 63,
After "connects" insert --support--.

UNITED STATES PATENT AND TRADEMARK OFFICE

CERTIFICATE OF CORRECTION

PATENT NO. : 5,141,284

DATED : August 25, 1992

INVENTOR(S) : Larry P. LaPointe

It is certified that error appears in the above-identified patent and that said Letters Patent is hereby corrected as shown below:

Column 9, line 13,
"angualr" should be --angular--.

Column 9, line 23,
"end" should be --leg--.

Column 9, line 32,
"locakble" should be --lockable--.

Column 9, line 46,
Delete "a".

Column 9, line 61,

"6" should be --36--.

Column 10, line 27,

"4" should be --34--.

UNITED STATES PATENT AND TRADEMARK OFFICE

CERTIFICATE OF CORRECTION

PATENT NO. : 5,141,284

DATED : August 25, 1992

INVENTOR(S) : Larry P. LaPointe

It is certified that error appears in the above-identified patent and that said Letters Patent is hereby corrected as shown below:

Column 11, line 22,
"exerted" should be --extended--.

Column 11, line 58,
"set" should be --seat--.

Column 12, line 66, Claim 3
Claim 1),
"or" should be --for--.

Column 16, line 20, Claim 18
Claim 19;
After "said" (second occurrence in patent and application) insert --seat--.

Signed and Sealed this

Sixteenth Day of November, 1993

*Attest:*

Bruce Lehman

BRUCE LEHMAN

*Attesting Officer*

*Commissioner of Patents and Trademarks*